US009980576B2

(12) United States Patent
Huang et al.

(10) Patent No.: US 9,980,576 B2
(45) Date of Patent: May 29, 2018

(54) DEVICE FOR OPENING OF ADJUSTABLE SOFA WITHOUT PAUSING AND MECHANICAL STRETCHING DEVICE THEREOF

(71) Applicant: Bruce Huang, Jiangsu (CN)

(72) Inventors: Bruce Huang, Jiangsu (CN); Daniel Wang, Jiangsu (CN); James Li, Jiangsu (CN); Jerry Zou, Jiangsu (CN); Lynn Wu, Jiangsu (CN)

(73) Assignee: REMACARO MACHINERY & TECHNOLOGY(WUJIANG) CO., LTD., Suzhou, Jiangsu (CN)

( * ) Notice: Subject to any disclaimer, the term of this patent is extended or adjusted under 35 U.S.C. 154(b) by 85 days.

(21) Appl. No.: 15/123,164

(22) PCT Filed: Mar. 12, 2015

(86) PCT No.: PCT/CN2015/074090
§ 371 (c)(1),
(2) Date: Sep. 1, 2016

(87) PCT Pub. No.: WO2016/008309
PCT Pub. Date: Jan. 21, 2016

(65) Prior Publication Data

US 2017/0071358 A1 Mar. 16, 2017

(30) Foreign Application Priority Data

Jul. 17, 2014 (CN) ..... 2014 1 0340863

(51) Int. Cl.
*A47C 20/12* (2006.01)
*A47C 1/0355* (2013.01)

(52) U.S. Cl.
CPC ..... *A47C 20/12* (2013.01); *A47C 1/0355* (2013.01)

(58) Field of Classification Search
CPC ..... A47C 1/0355; A47C 20/12
(Continued)

(56) References Cited

U.S. PATENT DOCUMENTS 5,013,084 A 5/1991 May
5,588,710 A 12/1996 Wiecek
(Continued)

FOREIGN PATENT DOCUMENTS

CN 201571760 9/2010
CN 102657449 9/2012
(Continued)

OTHER PUBLICATIONS

International Search Report, issued in the corresponding PCT Application No. PCT/CN2015/074090, dated Jun. 16, 2015, 8 pages.

*Primary Examiner* — Anthony D Barfield
(74) *Attorney, Agent, or Firm* — Hamre, Schumann, Mueller & Larson, P.C.

(57) ABSTRACT

Disclosed are a device for the opening of an adjustable sofa without pausing and a mechanical stretching device thereof. The device for the opening of an adjustable sofa consists of a leg drive connector (4), a first limit push connector (3), an expansion front swing limit (1), a second limit push connector (10), a back swing limit (6), a transmission connector (9), a third limit push connector (8), a limit push slide groove block (7) and a folding front swing limit (11). The leg drive connector (4) is rotatably connected to the first limit push connector (3). The transmission connector (9) is rotatably connected to the second limit push connector (10). The second limit push connector (10) is rotatably connected to the first limit push connector (3) and the third limit push connector (8). The back swing limit (6) is fixed on the third limit push connector (8) and located in a limit push slide groove (15). The expansion front swing limit (1) is fixed on
(Continued)

the second limit push connector (10). The expansion front swing limit (1) cooperates with a front swing connector (12) and the back swing limit (6) cooperates with a back swing connector (5).

3 Claims, 8 Drawing Sheets

(58) Field of Classification Search
USPC ..... 297/85 M, 85 L
See application file for complete search history.

(56) References Cited

U.S. PATENT DOCUMENTS

| | | | | |
|---|---|---|---|---|
| 5,772,278 | A * | 6/1998 | Kowalski | A47C 1/0355 297/85 L |
| 7,850,232 | B2 * | 12/2010 | Casteel | A47C 1/0352 297/85 L |
| 2008/0001442 | A1 * | 1/2008 | Wiecek | A47C 1/0355 297/85 L |

FOREIGN PATENT DOCUMENTS

| | | |
|---|---|---|
| CN | 203538831 | 4/2014 |
| CN | 203676624 | 7/2014 |
| CN | 104083016 | 10/2014 |
| CN | 204015714 | 12/2014 |

* cited by examiner

DEVICE FOR OPENING OF ADJUSTABLE SOFA WITHOUT PAUSING AND MECHANICAL STRETCHING DEVICE THEREOF

TECHNICAL FIELD OF THE INVENTION

The invention relates to a device for opening of adjustable sofa without pausing and a mechanical stretching device thereof, and in particular relates to a device for opening of adjustable sofa without pausing and a mechanical stretching device thereof in which the leg shelf can be folded or unfolded and the angle of the backrest can be slightly adjusted.

BACKGROUND OF THE INVENTION

The current mechanical stretching device of sofa has four major disadvantages: 1, in the market, the adjustable sofa pauses obviously when opened, influencing the comfortability of running of the sofa; 2, in the market, the opening limit device of the adjustable sofa will give rise to two hitting sounds, influencing the comfortability of the adjustable sofa; 3, in the market, in the electrically driving process of the adjustable sofa, the mechanical stretching device is opened in the swing process and the limit will be jammed so that the mechanical stretching device is damaged and even hurts users with serious potential safety hazard; and 4, in the market, the adjustable sofa opens the mechanical stretching device in the swing process so that there will be obvious shaking phenomenon, influencing the function and structural stability of the sofa. Referring to FIG. 7 and FIG. 8, in the market, the mechanical stretching device of adjustable sofa in the prior art comprises a hook connector 39, a limit drive connector 43, a contrast leg drive connector 44 (the "contrast" herein is used to be distinguished from the embodiment, similarly hereinafter), a contrast back swing connector 42, a contrast transmission connector 40, and a back swing connector limit 41. The back swing connector limit 41 is fixedly connected on the contrast back swing connector 42; the hook connector 39 is rotatably connected to the contrast transmission connector 40 via a first axis of rotation 45, rotatably connected to the limit drive connector 43 via a second axis of rotation 46, and rotatably connected to the contrast leg drive connector 44 via a third axis of rotation 47. When the contrast back swing connector 42 swings to a position in the opening process of the mechanical stretching device, the mechanical stretching device can be completely opened so as to give rise to the second pause only after the back swing connector limit 41 touches the limit groove on the hook connector 39 so as to give rise to the first pause. At this time, there will be obvious shaking phenomenon in the mechanical stretching device of adjustable sofa.

SUMMARY OF THE INVENTION

Technical Problem

The technical problem to be solved by the invention is to overcome the above disadvantages existing in the prior art, and provide a device for opening of adjustable sofa without pausing which is simple in structure, convenient to use, and is opened without pausing, and a mechanical stretching device thereof.

Solution to the Problem

Technical Solution

The technical solution adopted by the invention to solve the above technical problem is a device for the opening of an adjustable sofa without pausing, wherein the device for the opening of an adjustable sofa without pausing consists of a leg drive connector, a first limit push connector, an expansion front swing limit, a second limit push connector, a back swing limit, a transmission connector, a third limit push connector, a limit push slide groove block and a folding front swing limit; the leg drive connector is rotatably connected to the first limit push connector, the transmission connector is rotatably connected to the second limit push connector, the second limit push connector is rotatably connected to the first limit push connector and the third limit push connector; the limit push slide groove block is installed on the transmission connector, the limit push slide groove block is provided with a limit push slide groove, the back swing limit is fixed on the third limit push connector, the back swing limit is located in the limit push slide groove, the expansion front swing limit is fixed on the second limit push connector, the expansion front swing limit cooperates with a front swing connector, and the back swing limit cooperates with a back swing connector.

The mechanical stretching device of an adjustable sofa in accordance with the utility model comprises the above device for opening without pausing, the mechanical stretching device of an adjustable sofa has the same left side part and right side part which are fixedly connected via a fixing part, wherein both the left side part and the right side part are provided with a front rising connector, a foot pedal, a first foot rod, a second foot rod, a small foot pedal, a rolling groove connector, a backrest piece, a third foot rod, a front connector, a seat board, an installation piece, a rear pin connector, a leg drive connector, a first limit push connector, an expansion front swing limit, a second limit push connector, a back swing limit, a transmission connector, a third limit push connector, a limit push slide groove block, a folding front swing limit, a front rising connector lower limit, a front connector limit, a rolling wheel, and a front rising connector upper limit; the front connector is rotatably connected to the first foot rod and the second foot rod, respectively, the third foot rod is rotatably connected to the second foot rod, the leg drive connector and the seat board, the seat board is rotatably connected to the front rising connector and the backrest piece, the backrest piece is rotatably connected to the front rising connector, the rear pin connector and the rolling groove connector, the leg drive connector is rotatably connected to the rear pin connector via the rolling wheel, the rolling wheel moves within the groove on the rolling groove connector, the installation piece is fixed on the base of the adjustable sofa, the second foot rod is provided with the front connector limit, and the seat board is provided with the front rising connector lower limit and the front rising connector upper limit; when the front connector limit is in contact with a first limit surface of the front connector, and the front rising connector lower limit and the front rising connector upper limit touch the front rising connector, the mechanical stretching device is in the closed state; when the expansion front swing limit touches the front swing connector, the back swing limit touches the back swing connector, the front connector limit is in contact with a second limit surface of the front connector, and the front rising connector lower limit and the front rising connector upper limit touch the front rising connector, the mechanical stretching device is in the opened state.

The folding front swing limit in accordance with the invention is fixed on the second limit push connector; the back swing limit is fixed on the third limit push connector; when the mechanical stretching device of an adjustable sofa is opened, the following two actions that the folding front swing limit touches the front swing connector and the back swing limit touches the back swing connector are completed in a synchronous manner so that the mechanical stretching device of an adjustable sofa is opened very smoothly, solving the phenomenon that the adjustable sofa in the market shakes in the opening process, and improving the comfortability and the safety performance of the adjustable sofa.

Advantageous Effects of the Invention

Advantageous Effects

The device for the opening of an adjustable sofa without pausing in accordance with the invention has a simple structure, solving the problem that it is easy to pause when the adjustable sofa is opened efficiently.

The invention is simple in structure, convenient to use, opened without pausing, and good in comfortability and safety.

BRIEF DESCRIPTION OF THE DRAWINGS

in the FIGURE: 1—a expansion front swing limit; 2—a front rising connector lower limit; 3—a first limit push connector; 4—a leg drive connector; 5—a back swing connector; 6—a back swing limit; 7—a limit push slide groove block; 8—a third limit push connector; 9—a transmission connector; 10—a second limit push connector; 11—a folding front swing limit; 12—a front swing connector; 13—a front rising connector; 14—a fourth axis of rotation; 15—a limit push slide groove; 16—a fifth axis of rotation; 17—a rear pin connector; 18—a first limit surface; 19—a second limit surface; 20—a back connector; 21, 22, 23—a fixed riveting point; 24—a seventh axis of rotation; 27—a front connector limit; 28—an installation piece; 29—a seat board; 30—a front connector; 31—a small foot pedal; 32—a foot pedal; 33—a first foot rod; 34—a second foot rod; 35—a third foot rod; 36—a sixth axis of rotation; 37—a rolling groove connector; 38—a backrest piece; 48—a front rising connector upper limit; and 49—a rolling wheel.

DETAILED DESCRIPTION OF THE INVENTION

Figure 1:
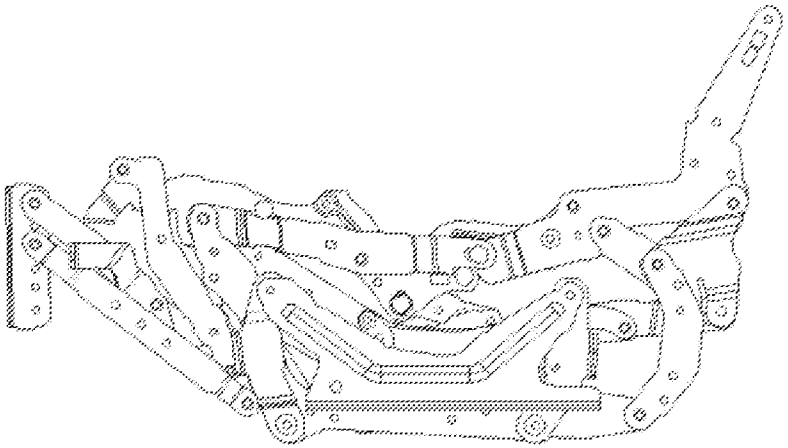
FIG. 1 shows a front schematic diagram when the leg and the backrest of the left part or the right part are completely folded (i.e. in the closed state) in accordance with the embodiment of the invention.
Figure 2:
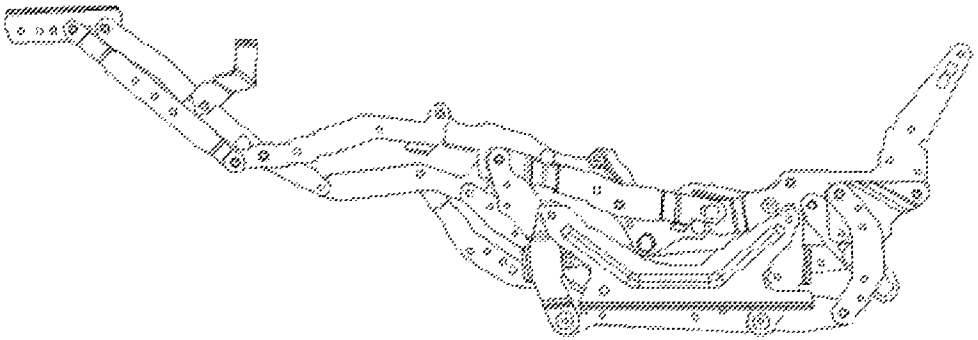
FIG. 2 shows a front schematic diagram when the leg of the left part or the right part is completely unfolded in accordance with the embodiment of the invention.
Figure 3:
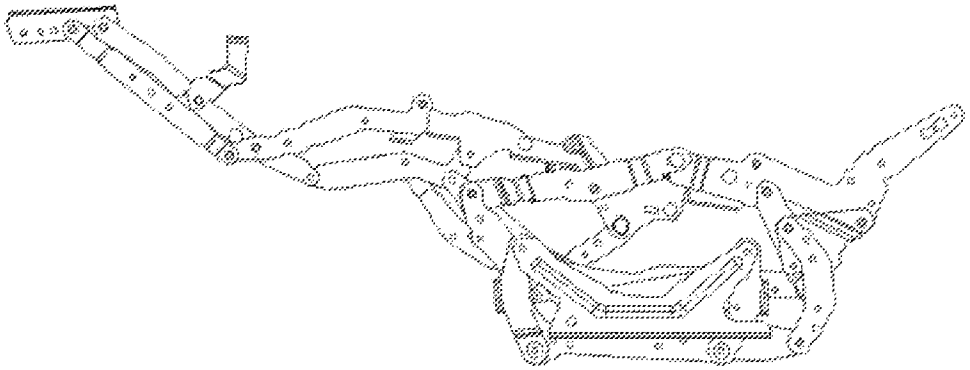
FIG. 3 shows a front schematic diagram when the leg of the left part or the right part is completely unfolded and the backrest is completely reversed (i.e. in the opened state) in accordance with the embodiment of the invention.
Figure 4:
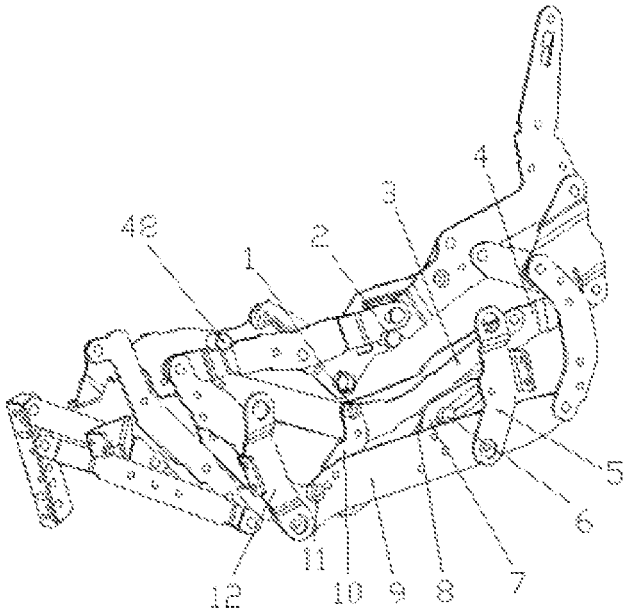
FIG. 4 shows a three-dimensional schematic diagram when the leg of the left part or the right part is completely folded in accordance with the embodiment of the invention.
Figure 5:
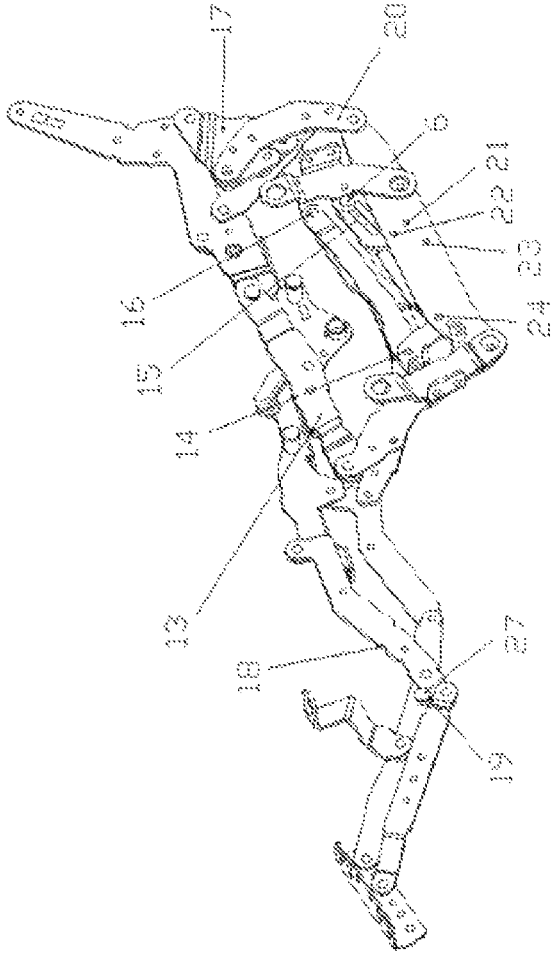
FIG. 5 shows a three-dimensional schematic diagram in the process that the leg of the left part or the right part is unfolded or folded in accordance with the embodiment of the invention.
Figure 6:
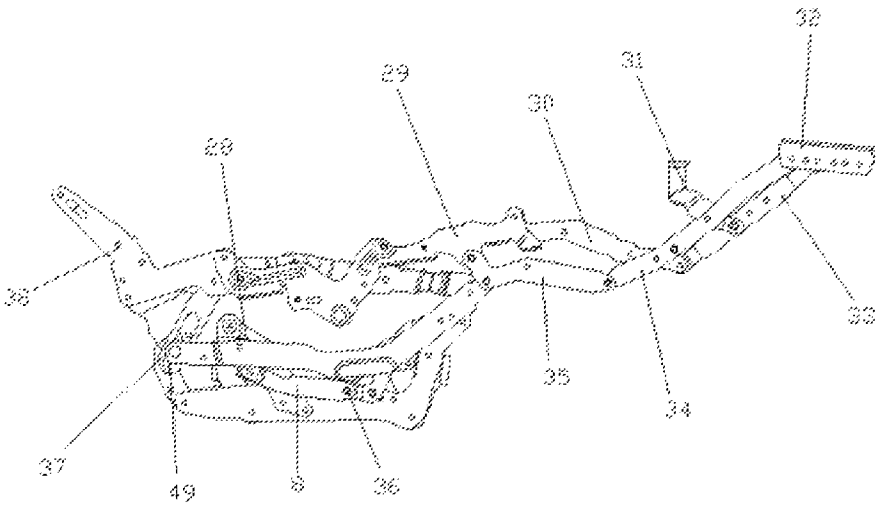
FIG. 6 shows a schematic diagram of another angle of the left part or the right part in accordance with the embodiment of the invention as shown in FIG. 5.
Figure 7:
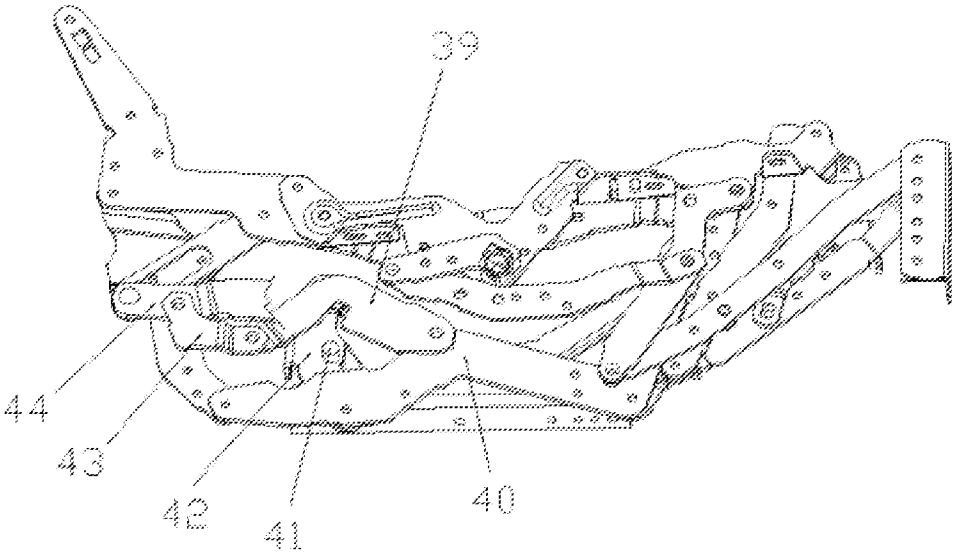
FIG. 7 and FIG. 8 show a schematic diagram of the main constituent parts and mode of operation in the prior art, in the figure: 39—a hook connector; 40—a contrast transmission connector; 41—a back swing connector limit; 42—a contrast back swing connector; 43—a limit drive connector; 44—a contrast leg drive connector; 45—a first axis of rotation; 46—a second axis of rotation; and 47—a third axis of rotation
Figure 8:
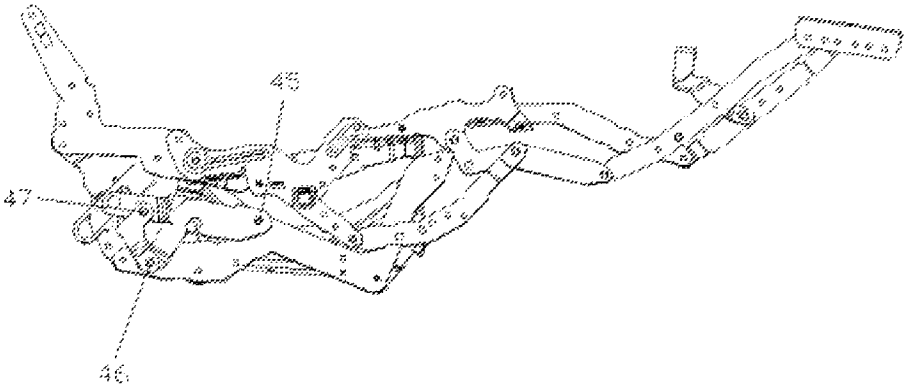

The invention will be further described in combination with the attached drawings and by means of embodiment.

The mechanical stretching device of an adjustable sofa in accordance with the embodiment is to re-design the device for opening without pausing on the basis of the mechanical stretching device in the prior art. The mechanical stretching device for the opening of an adjustable sofa without pausing has the same left side part and right side part which are fixedly connected via a fixing part.

The device for the opening of an adjustable sofa without pausing in accordance with the embodiment is provided with a leg drive connector 4, a first limit push connector 3, an expansion front swing limit 1, a second limit push connector 10, a back swing limit 6, a transmission connector 9, a third limit push connector 8, a limit push slide groove block 7 and a folding front swing limit 11. The leg drive connector 4 is rotatably connected to the first limit push connector 3. The transmission connector 9 is rotatably connected to the second limit push connector 10. The second limit push connector 10 is rotatably connected to the first limit push connector 3 and the third limit push connector 8; the limit push slide groove block 7 is installed on the transmission connector 9, the limit push slide groove block 7 is provided with a limit push slide groove 15, the back swing limit 6 is fixed on the third limit push connector 8, the back swing limit 6 is located in the limit push slide groove 15, and the back swing limit 6 cooperates with the back swing connector 5; the expansion front swing limit 1 is fixed on the second limit push connector 10, and the expansion front swing limit 1 cooperates with the front swing connector 12.

As a special case, both the left side part and the right side part of the mechanical stretching device of an adjustable sofa are provided with a front rising connector 13, a foot pedal 32, a first foot rod 33, a second foot rod 34, a small foot pedal 31, a rolling groove connector 37, a backrest piece 38, a third foot rod 35, a front connector 30, a seat board 29, a rear pin connector 17, a leg drive connector 4, a first limit push connector 3, an expansion front swing limit 1, a second limit push connector 10, a back swing limit 6, a transmission connector 9, a third limit push connector 8, a limit push slide groove block 7, a folding front swing limit 11, a front rising connector lower limit 2, a front connector limit 27, a rolling wheel 49, and a front rising connector upper limit 48; the front connector 30 is rotatably connected to the first foot rod 33, the second foot rod 34, and the seat board 29; the second foot rod 34 is rotatably connected to the foot pedal 32, the small foot pedal 31, and the first foot rod 33; the seat board 29 is rotatably connected to the third foot rod 35, the front connector 30, the backrest piece 38, and the front rising connector 13; the backrest piece 38 is rotatably connected to the seat board 29, the front rising connector 13, the rear pin connector 17, and the rolling groove connector 37; the leg drive connector 4 is rotatably connected to the rolling groove connector 37 via the rolling wheel 49, and is rotatably connected to the first limit push connector 3 and the third foot rod 35; the back connector is rotatably connected to the rear pin connector 17 and the transmission connector 9; the transmission connector 9 is rotatably connected to the back swing connector 5, the front swing connector 12, the front rising connector 13, and the second limit push connector 10; the installation piece 29 is rotatably connected to the back swing connector 5 and the front swing connector 12; the limit push slide groove block 7 is fixed above the transmission connector 9 via the fixed riveting point 21, 22, 23; the limit push slide groove block 7 is provided with a limit push slide groove 15; the second limit push connector 10 is rotatably connected to the first limit push connector 3 via the fourth axis of rotation 14, and is slidably connected to the third limit push connector 8 via the limit push slide groove 15; the back swing limit 6 is fixed on the third limit push connector 8 and is slidably connected thereto via the limit push slide groove 15; the second foot rod 34 is provided with the front connector limit 27, the seat board 29 is provided with the front rising connector lower limit 2 and the front rising connector upper limit 48, the transmission connector 9 is provided with the folding front swing limit 11, the second limit push connector 10 is provided with the expansion front swing limit 1, and the third limit push connector 8 is provided with the back swing limit 6; when the front connector limit 27 is in contact with the first limit surface 18 on the front connector 30, and the front rising connector lower limit 2 and the front rising connector upper limit 48 touch the front rising connector 13, the mechanical stretching device is in the closed state; when the expansion front swing limit 1 touches the front swing connector 12, the back swing limit 6 touches the back swing connector 5, the front connector limit 27 is in contact with the second limit surface 19 on the front connector 30, and the front rising connector lower limit 2 and the front rising connector upper limit 48 touch the front rising connector 13, the mechanical stretching device is in the opened state.

INDUSTRIAL APPLICABILITY

The movement principle of the device for opening without pausing in accordance with the embodiment lies in the fact that when the mechanical stretching device for the opening of an adjustable sofa without pausing is in the opening process, the transmission connector 9 pushes the first limit push connector 3 via the fifth axis of rotation 16, and the first limit push connector 3 pushes the second limit push connector 10 via the fourth axis of rotation 14, during which the expansion front swing limit 1 fixed on the second limit push connector 10 touches the front swing connector 12 so as to have the effect of limit; the second limit push connector 10 is rotatably connected to the transmission connector 9 via the seventh axis of rotation 24 and pushes the third limit push connector 8 to be rotatably connected via the sixth axis of rotation 36 at the same time, and the back swing limit 6 is fixed on the third limit push connector 8 to be slidably connected to the limit push slide groove 15, during which the back swing limit 6 touches the back swing connector 5 so as to have the effect of limit, and the limit push slide groove block 7 is fixedly connected with the transmission connector 9 via the fixed riveting point 21, 22, 23; in accordance with the embodiment, the following two actions that the back swing limit 6 touches the back swing connector 5 and the folding front swing limit 1 touches the front swing connector 12 are completed in a synchronous manner.

When the leg of the mechanical stretching device for the opening of an adjustable sofa without pausing in accordance with the embodiment is folded, when the adjustable sofa swings to the front in the swinging process, the folding front swing limit 11 will touch the front swing connector 12 so as to have the effect of limit; and when the adjustable sofa swings to the back, the back swing limit 6 will touch the back swing connector 5 so as to have the effect of limit. The purpose is to prevent users from overexertion in the swinging process so as to damage the mechanical stretching device and hurt the personal safety of users.

The mechanical stretching device for the opening of an adjustable sofa without pausing in accordance with the embodiment cancels the hook connector 39, the limit drive connector 43 and the back swing connector limit 41 in the original mechanical stretching device, helps improving the running smoothness of the adjustable sofa, and improving the comfortability and the safety performance of the sofa.

All the simple variants or equivalent changes of the invention should be considered to fall within the scope of protection of the invention.

The invention claimed is:

1. A device for the opening of an adjustable sofa without pausing, wherein the device for the opening of an adjustable sofa without pausing consists of a leg drive connector, a first limit push connector, an expansion front swing limit, a second limit push connector, a back swing limit, a transmission connector, a third limit push connector, a limit push slide groove block and a folding front swing limit; the leg drive connector is rotatably connected to the first limit push connector, the transmission connector is rotatably connected to the second limit push connector, the second limit push connector is rotatably connected to the first limit push connector and the third limit push connector; the limit push slide groove block is installed on the transmission connector, the limit push slide groove block is provided with a limit push slide groove, the back swing limit is fixed on the third limit push connector, the back swing limit is located in the limit push slide groove, the expansion front swing limit is fixed on the second limit push connector, the expansion front swing limit cooperates with a front swing connector and the back swing limit cooperates with a back swing connector.

2. A mechanical stretching device of an adjustable sofa, wherein the mechanical stretching device of an adjustable sofa has the same left side part and right side part which are fixedly connected via a fixing part, wherein both the left side part and the right side part are provided with a front rising connector, a foot pedal, a first foot rod, a second foot rod, a small foot pedal, a rolling groove connector, a backrest piece, a third foot rod, a front connector, a seat board, an installation piece, a rear pin connector, a leg drive connector, a first limit push connector, an expansion front swing limit, a second limit push connector, a back swing limit, a transmission connector, a third limit push connector, a limit push slide groove block, a folding front swing limit, a front rising connector lower limit, a front connector limit, a rolling wheel, and a front rising connector upper limit; the front connector is rotatably connected to the first foot rod and the second foot rod, respectively, the third foot rod is rotatably connected to the second foot rod, the leg drive connector and the seat board, the seat board is rotatably connected to the front rising connector and the backrest piece, the backrest piece is rotatably connected to the front rising connector, the rear pin connector, and the rolling groove connector, the leg drive connector is rotatably connected to the rear pin connector via the rolling wheel, the rolling wheel moves within the groove on the rolling groove connector, the installation piece is fixed on the base of the adjustable sofa, the second foot rod is provided with the front connector limit, and the seat board is provided with the front rising connector lower limit and the front rising connector upper limit.

3. The mechanical stretching device of an adjustable sofa according to claim 2, wherein when the mechanical stretching device of an adjustable sofa is opened, the folding front swing limit touches the front swing connector and the back swing limit touches the back swing connector in a synchronous manner.

* * * * *